United States Patent [19]

Brockmüller

[11] 3,945,562

[45] Mar. 23, 1976

[54] CROSS-BOTTOM BAG AND METHOD OF MAKING SAME

[75] Inventor: Friedrich Franz Brockmüller, Lengerich, Germany

[73] Assignee: Windmoller & Holscher, Lengerich, Germany

[22] Filed: Oct. 17, 1973

[21] Appl. No.: 407,090

[30] Foreign Application Priority Data

Oct. 10, 1972 Germany ..... 2251395

[52] U.S. Cl. ..... 229/62.5; 229/55; 229/58

[51] Int. Cl.[2] ..... B65D 31/14

[58] Field of Search ..... 229/62.5, 55, 57, 58, 59, 229/60; 150/9

[56] References Cited

UNITED STATES PATENTS

| | | | |
|---|---|---|---|
| 2,307,559 | 1/1943 | Angus | 229/62.5 X |
| 3,540,356 | 11/1970 | Lecomte | 229/55 X |
| 3,591,072 | 7/1971 | Sannino | 229/62.5 |
| 3,807,626 | 4/1974 | Goodrich | 229/55 |

*Primary Examiner*—William Price
*Assistant Examiner*—Stephen P. Garbe
*Attorney, Agent, or Firm*—Fleit & Jacobson

[57] ABSTRACT

In a composite bag comprising an outer bag and an inner bag which is secured thereto by adhesive, the outer bag is provided with a cross-bottom folded closure at least at one end where no filling valve is provided. Adjacent said one end of the outer bag, the inner bag is closed by a weld seam and folded back on itself and secured in position so that, in a flattened condition of the composite bag when the cross-bottom folded closure lies snug against the bag body, the inner bag extends no further than the centre line of the cross-bottom closure.

12 Claims, 31 Drawing Figures

P

24
X

P

X
25

P

16
X

P

P

P

X
16

20
X

X
21

CROSS-BOTTOM BAG AND METHOD OF MAKING SAME

The invention relates to a composite cross-bottom bag and to a method of making same. More particularly, the invention is concerned with a composite bag comprising a single or multi-ply outer bag of, say, paper closed at least at one end by cross-bottom folding, and a plastics inner bag secured to the outer bag.

Such a bag and a method of making same have already been suggested by us in German Specification P 21 55 265.8. In this case, the inner bag is incorporated in the cross-bottom closure of the outer bag but without hindering the proper securing of the cross-bottom folding by adhesive, the inner bag being itself closable by separate applications of adhesive. This form of closure has a particular advantage over other closures (such as that described in German Specifications 1 802 854), namely, that a plastics tube which serves as a filling valve can be inserted in the cross-bottom closure before it is finally secured, in much the same way as is known for unlined paper bags, the tube opening into the inner bag and being sealed into the folded flaps of the cross-bottom closure by means of specially applied adhesive. On the other hand, our previously suggested construction for a cross-bottom closure is comparatively expensive.

Valved cross-bottom bags which are provided with a cross-bottom closure at both ends really require only one filling valve and only at one end of the bag. The invention therefore aims to provide a cross-bottom closure at the other end without complicating the manufacture and at the same time ensuring that the inner bag will in no way interfere with the cross-bottom folding or become damaged during folding, as could be the case in the aforementioned German Specification 1 802 854.

According to the invention, there is provided a composite cross-bottom bag comprising an outer bag having a plastics inner bag secured thereto, the outer bag being provided with a cross-bottom folded closure at least at one end where no filling valve is provided, wherein a first end of said inner bag adjacent said one end of the outer bag is closed by a weld seam and is folded back on itself and secured in position so that, in a flattened condition of the composite bag when the cross-bottom folded closure lies snug against the bag body, the inner bag extends no further than the centre line of the cross-bottom closure.

By means of this construction, the inner bag is not incorporated in the cross-bottom closure of the outer bag but, during filling of the composite bag, the inner bag becomes unfolded and comes to lie closely against the base of the outer bag and the adjoining side walls of the outer bag, thereby avoiding over-stressing of the thin inner bag which is not intended to bear the weight of the contents.

In a first form of the invention, the welded first end of the inner bag is simply folded back on itself through 180°.

In another form of the invention, the welded first end of the inner bag is twice folded back on itself to assume a Z-formation. In this case, the total length of the folded back portion need be only one half of that when the bag is folded back once through 180° and as a result the inner bag will readily unfold itself during filling.

At the other end of the outer bag, i.e., at the end remote from that where the inner bag is folded back on itself, the inner bag is preferably secured to the outer bag. To avoid undue stretching of the inner bag at this other end of the outer bag, an unfolded portion of the inner bag adjacent the back folding thereof is desirably secured to the outer bag at a side of the inner bag remote from the back folding, preferably by means of a transverse row of dabs of adhesive and as closely as possible to the fold line, or first fold line, of the back folding.

The invention also extends to a method of making the aforementioned composite cross-bottom bags, wherein inner bags preformed with back folding at the said first end are placed to lie at intervals on a single or multi-ply web of material for forming the outer bags, the web having adhesive preapplied thereto and the inner bags being arranged in a predetermined relationship to said adhesive, the longitudinal edges of the web are brought together and interconnected by preapplied further adhesive to form a tube successively enveloping the inner bags, outer bags, each containing one of the inner bags, are successively severed from the tube by cutting or by tearing along preformed perforations, and a cross-bottom folded closure is applied to each outer bag at an end adjacent to the said first end of the associated inner bag.

This method, which is a development of the method described in French Specification 2 000 222, permits fully mechanised manufacture of the composite bags, and in particular the unvalved cross-bottom closures thereof, without taking any special measures that might make manufacture more costly. The sequence for supplying the web with inner bags which are simply folded back through 180° at their welded ends can likewise be carried out fully mechanically by the method and apparatus of German Specification 2 110 815. If the inner bags contain back folding of Z formation, the sequence can again be fully mechanised by means of the method and apparatus of German Specification 22 44 697.5.

Various examples of the invention will now be described with reference to the accompanying drawings wherein.

Figure 24:
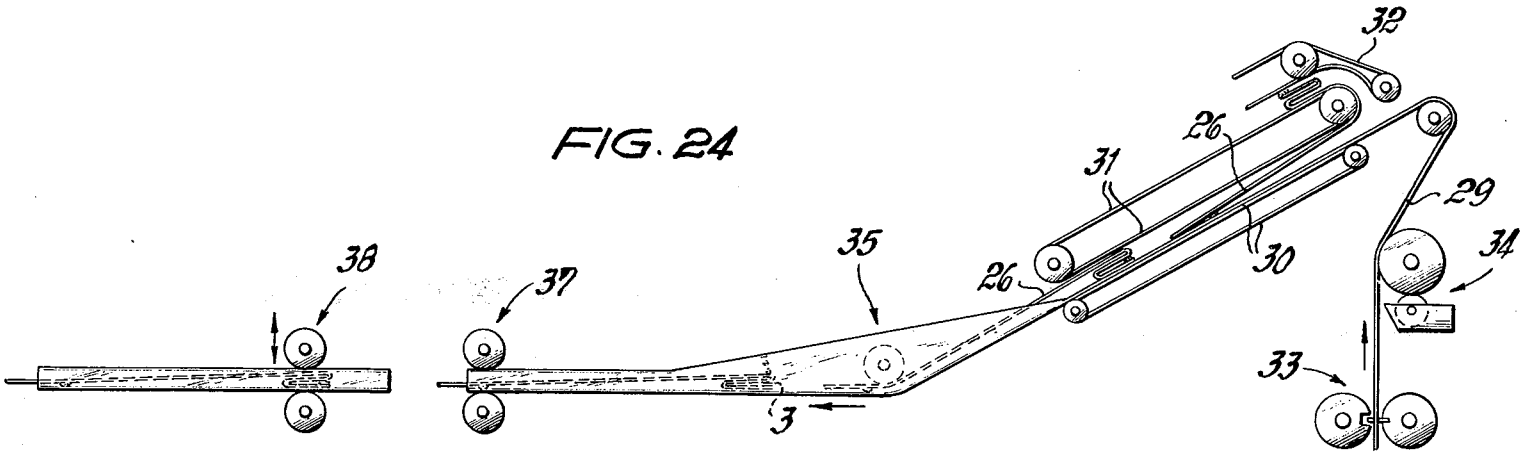
Figure 25:
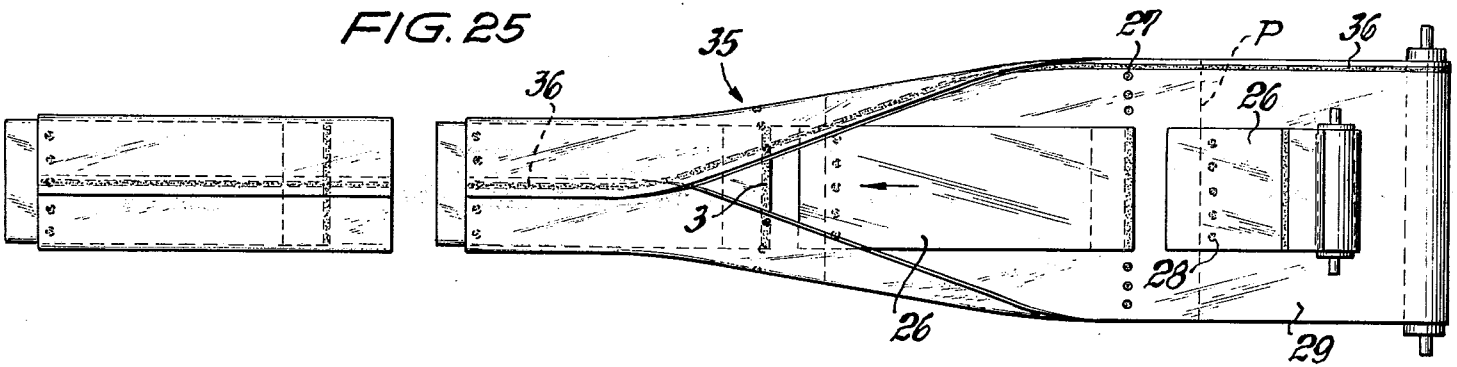

FIGS. 18*a* to 23*a* are sections each showing a tube length for making one of the FIGS. 13 to 17 composite bags;

FIGS. 18*b* to 23*b* are sections showing the tube lengths of FIGS. 18*a* to 23*a* in the course of being formed;

FIG. 24 is a diagrammatic side elevation of equipment for forming the composite bags; and FIG. 25 is a plan view of the FIG. 24 equipment.

Figure 1:
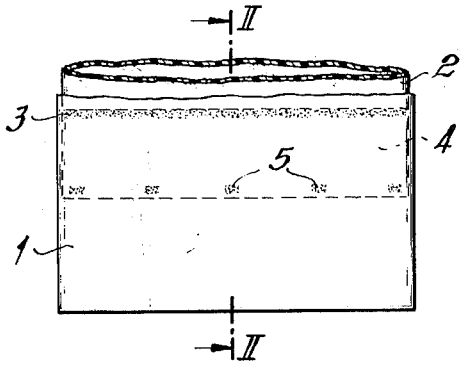
FIG. 1 is a fragmentary side elevation of flattened tube sections for a composite bag of which the outer bag is to be provided with a cross-bottom closure.
Figure 2:
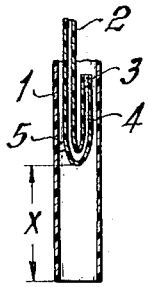
FIG. 2 is a section on the line II—II in FIG. 1.
Figure 3:
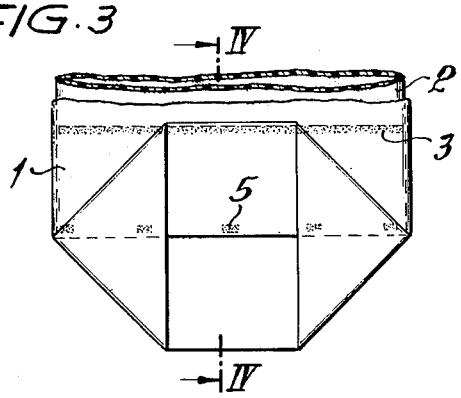
FIG. 3 is a view similar to FIG. 1 but in which the cross-bottom closure is in the process of being formed.
Figure 4:
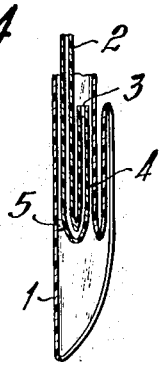
FIG. 4 is a section on the line IV—IV in FIG. 3.
Figure 5:
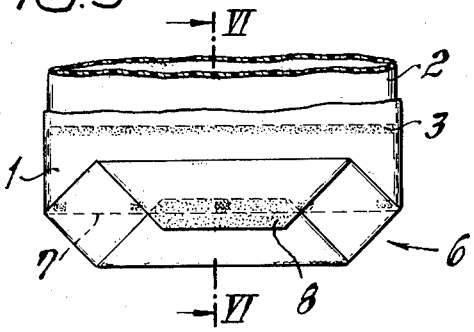
FIG. 5 is a view similar to FIG. 3 but in which the cross-bottom closure has been finally formed.
Figure 6:
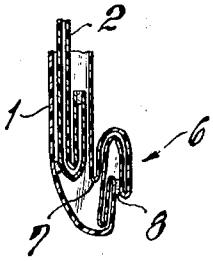
FIG. 6 is a section on the line VI—VI in FIG. 5.
Figure 7:
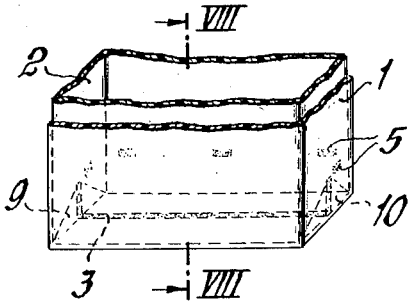
FIG. 7 is a fragmentary perspective view showing the composite bag of FIG. 5 in an expanded condition that it would assume after filling.

FIGS. 1 to 8 illustrate that end of a composite bag where no filling valve is to be provided, a cross-bottom closure for the outer bag being shown in various stages of production in FIGS. 3 to 8. In FIGS. 1 and 2, the outer bag is shown in a condition before folding has been commenced. A flattened tubular section 1 for forming the outer bag comprises one or more plies and inserted in it there is an inner bag 2 of which the end 4 has been folded back simply through 180° and the end edges are welded shut by a weld seam 3. By means of a transverse row of adhesive dabs 5 the inner bag is secured at a spacing *x* from the end of the outer bag so that the part of the outer bag containing no insert is sufficient to form a cross-bottom closure 6 (FIGS. 5 and 6), whereafter the inner bag will not extend further than the centre line 7 of the cross-bottom closure when the latter lies snug against the bag body as shown in FIGS. 5 and 6. The formation of the cross-bottom closure will therefore be in no way impeded by the inner bag; nor will the inner bag become damaged in the process. FIGS. 3 and 4 illustrate an intermediate stage in the fomration of the cross-bottom closure and in FIGS. 5 and 6 the closure 6 has been finally formed and secured by means of adhesive 8.

The folded back portion 4 of the inner bag 2 has a length which is approximately equal to the width of the cross-bottom closure 6 and is therefore sufficient to line the base of the outer bag when the composite bag becomes erected during filling. During the filling process, the folded portion 4 of the inner bag becomes unfolded to lie closely adjacent the cross-bottom closure, triangular corners 9 and 10 being formed in the inner bag in the process; these corners come to lie against the narrow sides of the erected composite bag.

The construction of FIGS. 9 to 12 differs from that illustrated in FIGS. 5 to 8 only in that the end portion 11 of the inner bag adjacent the weld line 3 is folded back on itself in Z formation. This facilitates unfolding of the inner bag during filling because the extent of back folding is only half of that in FIGS. 5 to 8. The unfolded portion of the inner bag adjacent the back folding is secured to the outer bag by dabs 12 of adhesive at the side remote from the back folding.

FIGS. 13 to 17 illustrate various composite bags incorporating an unvalved cross-bottom closure at one end. More particularly, in FIG. 13 the outer bag at the other end of the composite bag is provided with a valved cross-bottom closure and in FIGS. 14 to 17 the other end of the composite bag is left open.

Figure 8:
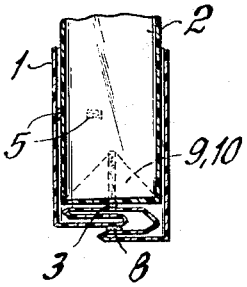
FIG. 8 is a section on the line VIII—VIII in FIG. 7.
Figure 9:
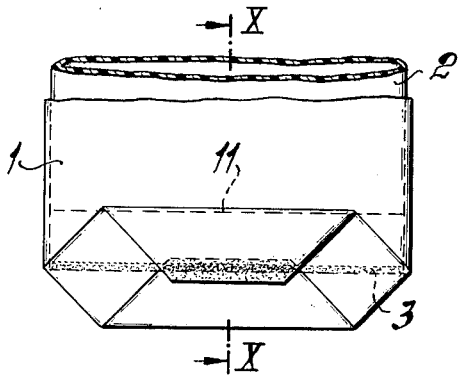
FIGS. 9 to 12 are views corresponding to FIGS. 5 to 8, respectively, but of a composite bag in which the inner bag has a modified construction.
Figure 10:
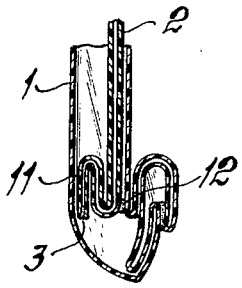
Figure 11:
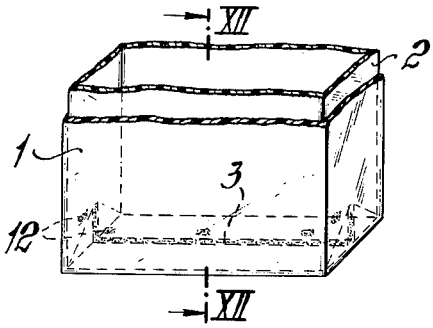
Figure 12:
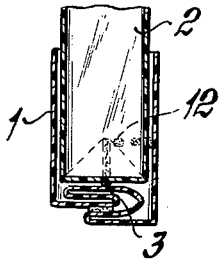
Figure 13:
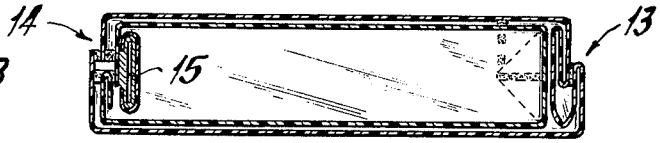
FIG. 13 is a cross-section through a composite bag according to FIGS. 1 to 8 or FIGS. 9 to 12 in the condition that it would assume after filling.

Referring to FIGS. 13, the end without a valve is designated 13; it is shown as being constructed in accordance with the FIG. 8 embodiment but could be in accordance with FIG. 12. The other or filling end 14 of the FIG. 13 composite bag incorporates a valve tube 15 and is made as described in our German Specification P 21 55 265.8. By reason of the present invention, only the cross-bottom closure for the valved end 14 need be made by the more expensive method. The cross-bottom closure without a valve is very readily formed and the welded end of the inner bag at this end of the composite bag will be substantially 100% leak-proof.

Figure 14:
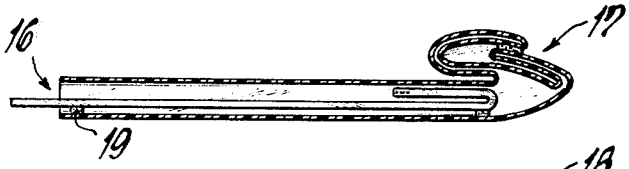
FIGS. 14 and 15 are views similar to FIGS. 6 and 10, respectively, but showing the entire composite bag in a flattened condition and demonstrating two possible constructions for the filling end of the composite bag.
Figure 15:
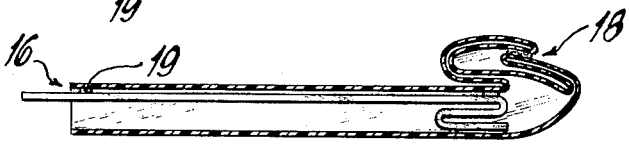

FIGS. 14 and 15 show two different embodiments where the filling end 16 of the composite bag is left open and the inner bag projects beyond the outer bag to be welded shut after filling and inserted in the outer bag before the latter is closed. The unvalved end 17 in FIG. 14 has the inner bag simly folded back in the manner previously described with reference to FIGS. 1 to 8 whilst the end 18 in FIG. 15 is constructed as described with reference to FIGS. 9 to 12. At the filling end 16, the inner bag is secured to the outer bag by dabs 19 of adhesive, but this is optional. What is important is that somewhere or other the inner bag should be secured to the outer bag, this being best achieved at the unvalved end 17 or 18 so as to prevent the entire inner bag from sliding downwardly during filling, which would make the unfolding of the back folded portion of the inner bag quite impossible.

Figure 16:
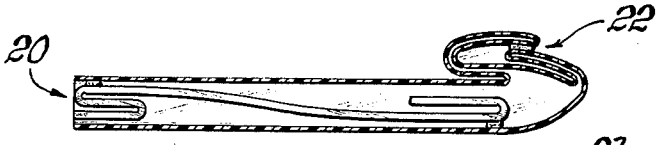
FIGS. 16 and 17 are views corresponding to FIGS. 6 and 10, respectively, and again showing the entire composite bag in a flattened condition and demonstrating two further possible constructions for the filling end of the composite bag.
Figure 17:
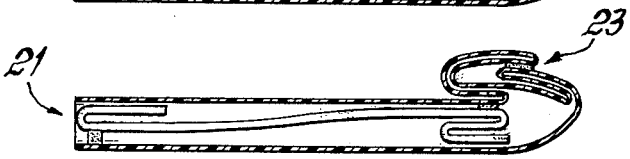

In FIGS. 16 and 17, the inner bag is folded back in Z formation and through 180°, respectively, at the filling end 20 and 21, respectively, so as to be inserted in the outer bag. It is not pulled out again until just before the filling operation. At the unvalved end 22 and 23, respectively, a form of folding for the inner bag is chosen which is different from that at the other end. Thus, if at the end 20 the inner bag is folded back in Z formation, it is simply folded back through 180° at the end 22 as shown in FIG. 16. Conversely, in FIG. 17 the inner bag is folded back in Z formation at the end 23 because it is folded back through 180° at the end 21. The reasone for this is that we have developed a technique for mechanising the production of inner bags having simple folding at one end and Z folding at the other, but not the same at both ends.

Figures 18A, 18B, 19A, 19B, 20A, 20B:
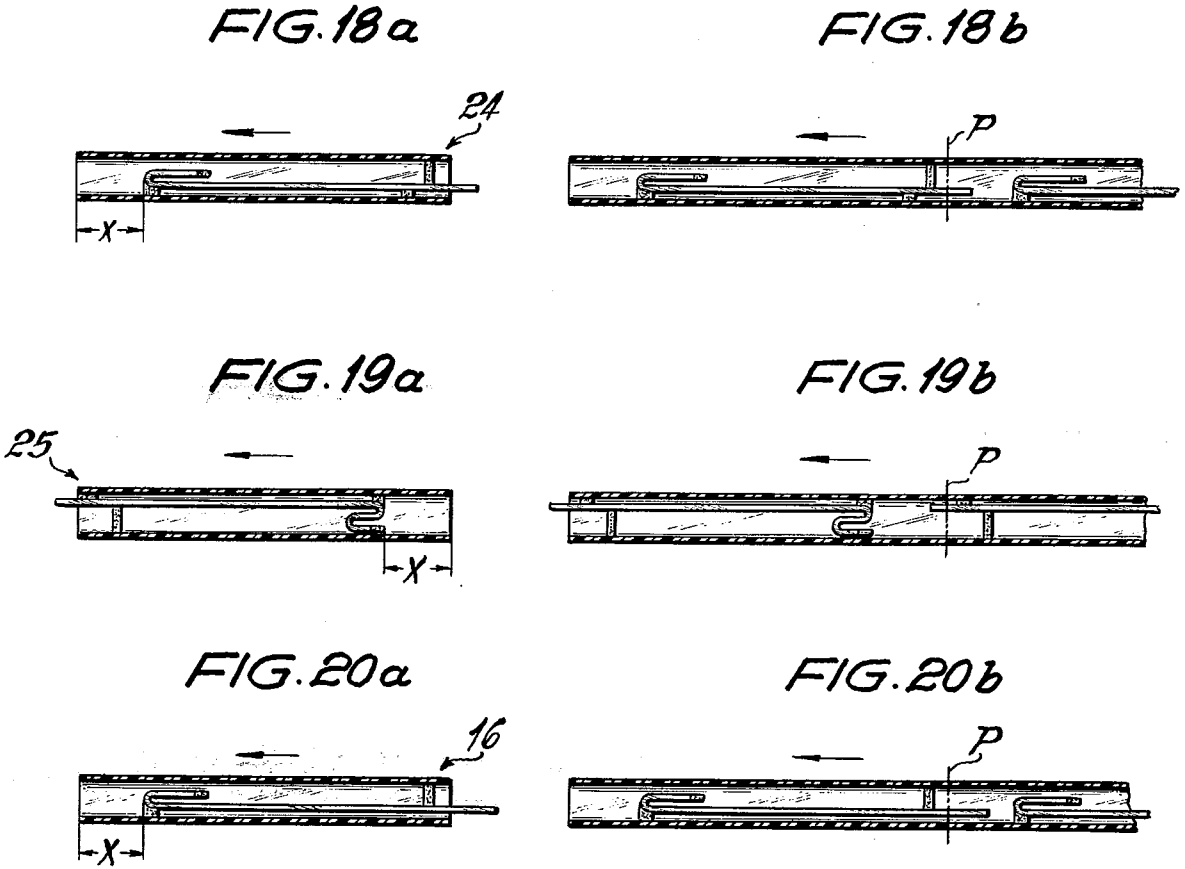

The embodiments of composite bag as described with reference to FIGS. 13 to 17 are produced with the aid of bag blanks according to FIGS. 18*a* to 23*a*, the FIG. 18*a* embodiment being used to make a composite bag according to FIG. 13 and the FIG. 19*a* embodiment being used to make a composite bag according to FIGS. 9 to 12. In each case, at the unvalved end of the bag blanks the inner bag is spaced from the end of the outer bag by the distance *x*. The direction of travel of the outer bag blank during manufacture is indicated by the arrows and it will be seen that, where the inner bag is simply folded back through 180°, the unvalved end constitutes the leading end, but when the inner bag is folded back in Z formation the unvalved end constitutes the trailing end. This arrangement is chosen because it has been found most satisfactory for fully automated production. Accordingly, the end 24 in FIG. 18*a* and the end 25 in FIG. 19*a* are destined to form the valved end 14 (FIG. 13) of the finished composite bag. It will be evident that the bag blanks according to FIGS. 20*a*, 21*a*, 22*a* and 23*a* will result in the embodiments of FIGS. 14 to 17, respectively.

Figures 21A, 21B, 22A, 22B, 23A, 23B:
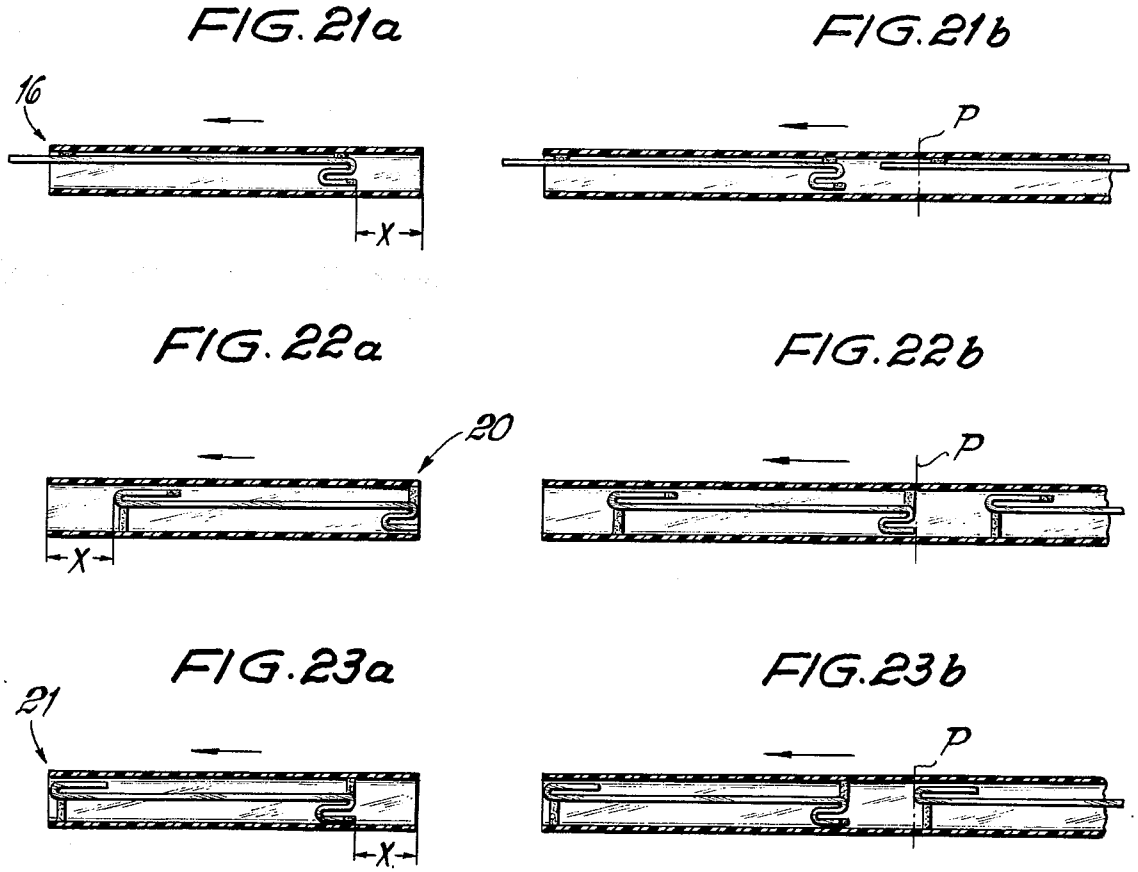

Each tube blank for the outer bag in FIGS. 18*a* to 23*a* is obtained by severing from a tubular web along a predetermined severing line indicated at P in FIGS. 18*b* to 23*b*. In the case of FIGS. 18*b* to 21*b*, where the inner bag projects beyond the severing line P, the web of material for the outer bags is provided at the severing line with a line of perforations, the leading section then being successively torn off the web along the perforations with the respective inner bag located therein but projecting somewhat therebeyond. In the embodiment of FIGS. 22*b* and 23*b*, in which the inner bag does not project beyond the severing line P, a simple transverse cut through the tubular web can be used to sever the leading sections.

Equipment for making the composite bags from a tubular web of material for the outer bags, the inner bags being provided with back folding and secured at proper spacings within the web, is illustrated in FIGS. 24 and 25. Inner bags 26, each preformed with a welded and closure and with back folding in a manner as hereinbefore described are applied to a single or multi-ply travelling web 29 of material for making the outer bags and secured in position by means of transverse lines of adhesive dabs 27, and possibly 28, on the web. The inner bags are applied in proper relationship to the adhesive dabs and perforations by means of a system of circulating belts 30, 31 and 32. The reference 33 diagrammatically indicates means for applying the transverse perforations P to the web whilst 34 diagrammatically indicates means for applying adhesive to the web. At the location indicated by the reference 35, the longitudinal edges of the web 29 are brought together and secured to each other by means of adhesive 36 to envelop the inner bags and form a tube. Feeding of the material for the outer bags is effected by feeding means 37 and severing of each outer bag from the leading end of the web along one line of the perforations P is effected by severing means 38. In a modification, where each inner bag does not project beyond its associated severed outer bag, the material for the outer bag may be severed by a cutting knife which would be located between the pairs of rollers 37 and 38; in that case, the rollers 38 will serve to hold the web tight during cutting and to feed the severed tubular blank.

For reasons of stability, open bags are provided with a cross-bottom closure at the base. Accordingly, the present invention is applicable to open bags generally, quite apart from bags that are closed at the top by a valved cross-bottom closure. In addition to the previously described and illustrated embodiments of bags that are open or closed at the filling end, other variations are of course possible. For example, the inner bag may be flush with the end of the outer bag at the filling end and, to facilitate opening of the bag, the inner bag may be secured to the outer bag at both sides, i.e., around the entire periphery, instead of at only one side. If the inner bag is secured at both sides, it may project beyond the outer bag at the filling end so that it can be turned over the end of the outer bag and thereby produce a clean filling orifice. In this case, the open bags may be used for garbage sacks which are tied shut after use.

I claim:

1. A composite cross-bottom bag comprising:

an outer bag having longitudinal side edges and at one end a cross-bottom folded closure having a cross-bottom fold center line extending transversely between the longitudinal side edges of said outer bag, said outer bag being in a flattened condition with said cross-bottom closure lying snugly against the body thereof; and an inner bag disposed within said outer bag and secured thereto, said inner bag being folded back on itself to define a lower fold line, said lower fold line being positioned at a selected location between the cross-bottom fold center line and the other end of said outer bag.

2. A composite bag according to claim 1, wherein said inner bag is folded back on itself through 180°.

3. A composite bag according to claim 1, wherein said inner bag is twice folded back on itself to assume a Z formation.

4. A composite bag according to claim 1, wherein said folded inner bag forms a back folding and wherein an unfolded portion of the inner bag adjacent the lower fold line thereof is secured to the outer bag at a side of the inner bag remote from the back folding.

5. A composite bag according to claim 4, wherein the inner bag is secured to the outer bag by a transverse row of dabs of adhesive.

6. A composite bag according to claim 1, wherein the other end of the outer bag is provided with a cross-bottom folded closure and incorporates a filling valve.

7. A composite bag according to claim 1, wherein the other end of the outer bag is open and the inner bag projects therebeyond.

8. A composite bag according to claim 1 wherein the other end of the outer bag is open and the end of the inner bag which is remote from said lower fold line is folded back through 180° to be flush with said other end.

9. A composite bag according claim 7, wherein one side of the inner bag is secured to the outer bag near said other end thereof.

10. A composite bag according claim 1, wherein the other end of the outer bag is open and the inner bag is flush with said other end and is secured on both sides thereof to the outer bag at said other end.

11. The composite bag according to claim 1 wherein the other end of the outer bag is open and the end of said inner bag which is remote from said lower fold line projects beyond said open end and said inner bag is secured to the outer bag at a location above said lower fold line.

12. A composite bag according to claim 11, wherein the other end of the outer bag is open and the end of the inner bag which is remote from said lower fold line is folded in Z formation to be flush with said outer bag other end.

* * * * *